US009964372B1

(12) United States Patent
O'Clair

(10) Patent No.: US 9,964,372 B1
(45) Date of Patent: May 8, 2018

(54) AMBIDEXTROUS MAGAZINE CATCH

(71) Applicant: Smith & Wesson Corp., Springfield, MA (US)

(72) Inventor: Sean O'Clair, Feeding Hills, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days. days.

(21) Appl. No.: 15/475,546

(22) Filed: Mar. 31, 2017

(51) Int. Cl.
*F41A 17/36* (2006.01)
*F41A 9/59* (2006.01)
*F41A 35/06* (2006.01)

(52) U.S. Cl.
CPC ..... *F41A 9/59* (2013.01); *F41A 35/06* (2013.01)

(58) Field of Classification Search
USPC ..... 42/7, 6, 18, 22
See application file for complete search history.

(56) References Cited

U.S. PATENT DOCUMENTS

| | | | | |
|---|---|---|---|---|
| 4,521,985 | A | 6/1985 | Smith et al. | |
| 4,713,902 | A | 12/1987 | Wigton | |
| 4,759,144 | A * | 7/1988 | Egan | F41A 17/38 42/7 |
| 7,596,900 | B2 | 10/2009 | Robinson et al. | |
| 9,417,020 | B2 * | 8/2016 | McGinty | F41A 35/06 |
| 9,541,340 | B2 * | 1/2017 | Fluhr | F41A 17/38 |
| 2009/0031605 | A1 | 2/2009 | Robinson | |

* cited by examiner

*Primary Examiner* — John W Eldred
(74) *Attorney, Agent, or Firm* — John A. Chionchio, Esquire; Ballard Spahr LLP

(57) ABSTRACT

An ambidextrous magazine catch for a firearm has a body movable on the frame of the firearm. A dog is rotatably mounted on the body. The dog has a jaw which is movable toward and away from the magazine well upon either motion of the body or rotation of the dog. The jaw engages a magazine in the magazine well. A plunger engaged with the body effects rotation of the dog through a cam surface on the plunger and a cam follower on the dog.

14 Claims, 4 Drawing Sheets

FIG. 1
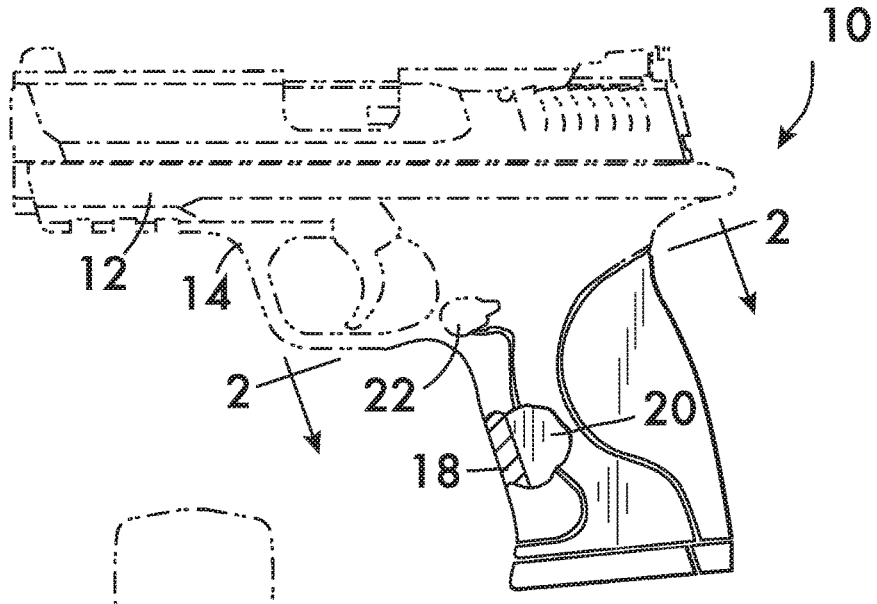
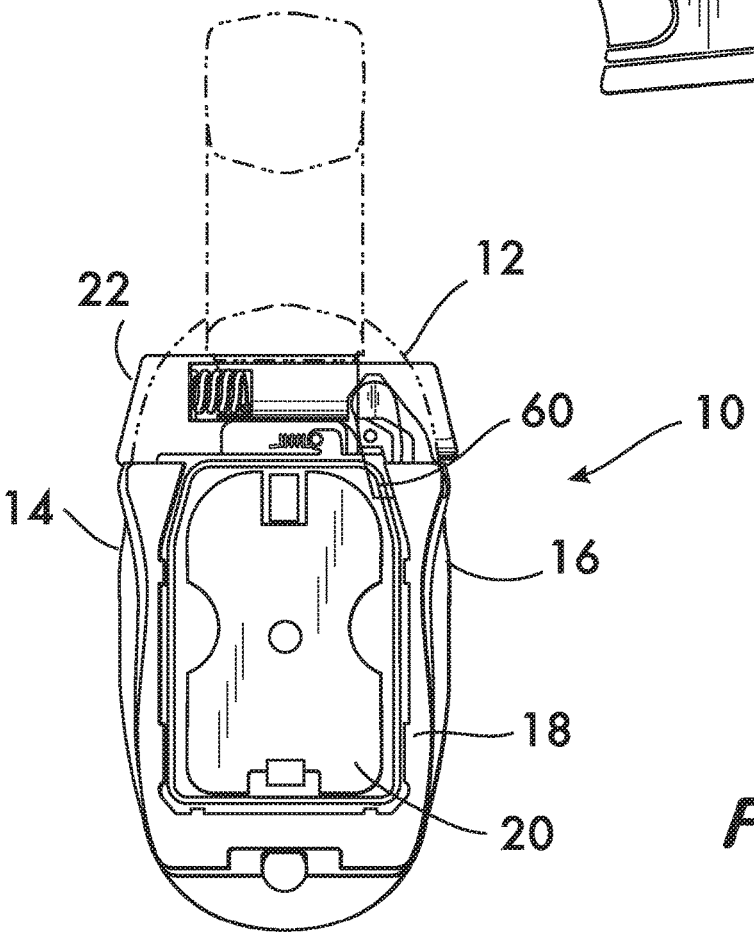
FIG. 2

FIG. 3
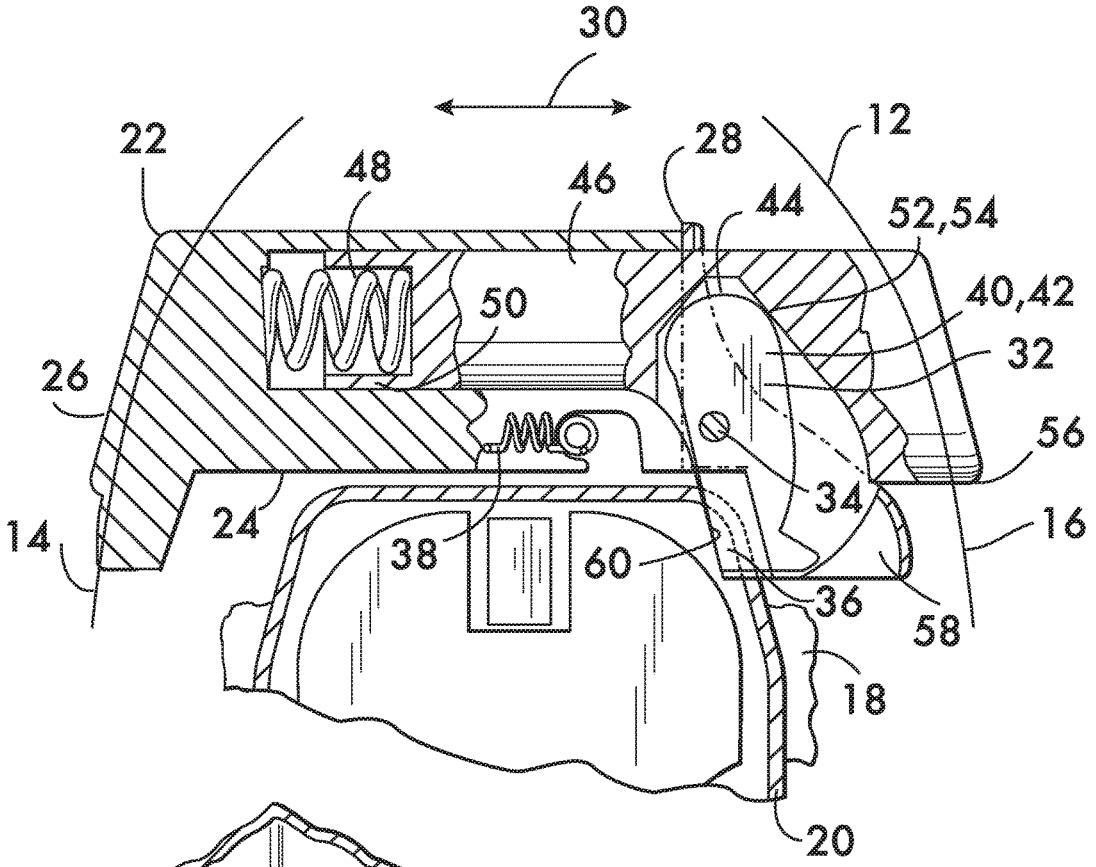
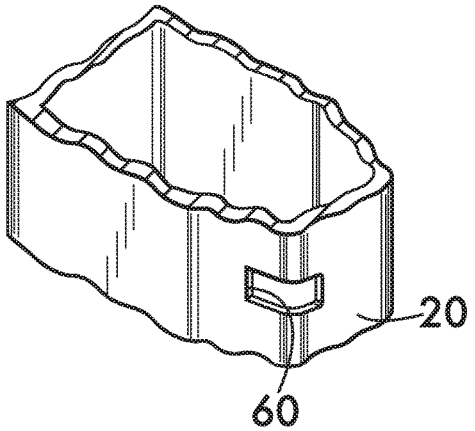
FIG. 3A

AMBIDEXTROUS MAGAZINE CATCH

FIELD OF THE INVENTION

This invention relates to a magazine catch for semiautomatic pistols.

BACKGROUND

It is advantageous for a firearm such as a semiautomatic pistol to accommodate both right handed and left handed shooters. Such a pistol is designated as "ambidextrous", i.e., capable of use with equal facility with either the right or left hand. To be ambidextrous means that the various controls on the pistol, for example, the slide catch, the manual safety and the magazine catch, should be readily actuatable by the "strong" hand, i.e., the hand holding the pistol.

Ambidextrous magazine catches according to the prior art, while effective, tend to be complicated. There is clearly an opportunity to provide an improved ambidextrous magazine catch which is simple in design and reliable in operation.

SUMMARY

The invention concerns a magazine catch for a firearm having a magazine well. In one example embodiment the catch comprises a body mountable on the firearm adjacent to the magazine well. A first end of the body is positionable proximate to a first side of the firearm. A second end of the body is positionable proximate to a second side of the firearm disposed oppositely from the first side. The body is movable in a direction oriented transversely to the first and second sides. A body spring acts directly between the firearm and the body and biases the jaw toward the magazine well. A dog is positioned proximate to a second end of the body. The dog is attached to the body for rotation about a rotation axis. The dog has a jaw positioned on one side of the rotation axis and a cam follower positioned on an opposite side of the rotation axis. A plunger engages the second end of the body. The plunger is movable toward and away from the first end of the body. A plunger spring acts between the body and the plunger for biasing the plunger away from the first end of the body. A cam surface is positioned on the plunger. The cam surface engages the cam follower and rotates the dog upon motion of the plunger toward and away from the first end of the body. Wherein the jaw is movable toward and away from the magazine well upon motion of the body transversely to the firing axis and motion of the plunger relatively to the body.

In one example embodiment of the magazine catch the body defines a cavity extending between the first and second ends thereof. The plunger is received within the cavity. The plunger spring is located within the cavity.

Further by way of example the plunger comprises a shroud surrounding at least a portion of the dog. In an example embodiment the shroud has an interior surface defining the cam surface. Also by way of example, a cover is positioned on the second end of the body. The cover overlies at least a portion of the jaw. In a specific example embodiment the rotation axis is oriented transversely to the body. In a further example the cam follower comprises a lobe having a curved perimeter.

The invention also encompasses a firearm. In one example embodiment the firearm comprises a frame having first and second sides oppositely disposed. The frame defines a magazine well therebetween. A body is mounted on the frame adjacent to the magazine well. A first end of the body is positioned proximate to the first side of the frame. A second end of the body is positioned proximate to the second side of the frame. The body is movable transversely to the first and second sides of the frame. A body spring acts directly between the firearm and the body and biases the jaw toward the magazine well. A dog is positioned proximate to the second end of the body. The dog is attached to the body for rotation about a rotation axis. The dog has a jaw positioned on one side of the rotation axis and a cam follower positioned on an opposite side of the rotation axis. A plunger engages the second end of the body. The plunger is movable toward and away from the first end of the body. A plunger spring acts between the body and the plunger for biasing the plunger away from the first end of the body. A cam surface is positioned on the plunger. The cam surface engages the cam follower and rotates the dog upon motion of the plunger toward and away from the first end of the body. Wherein the jaw is movable toward and away from the magazine well upon motion of the body transversely to the sides of the frame and motion of the plunger relatively to the body.

In an example embodiment the body defines a cavity extending between the first and second ends thereof. Further by way of example the plunger is received within the cavity. The plunger spring is located within the cavity in this example. In another example embodiment the plunger further comprises a shroud surrounding at least a portion of the dog. Further by way of example the shroud has an interior surface defining the cam surface. Again by way of example a cover is positioned on the second end of the body. The cover overlies at least a portion of the jaw in this example.

In an example embodiment the rotation axis is oriented transversely to the body. Further by way of example the cam follower comprises a lobe having a curved perimeter.

BRIEF DESCRIPTION OF THE DRAWINGS

FIG. 1 is a side view of an example pistol having an example magazine catch according to the invention;

FIG. 2 is a sectional view taken at line 2-2 of FIG. 1 showing an example embodiment of a magazine catch according to the invention;

FIG. 3A shows an isometric view of a portion of a magazine; and

FIGS. 3-5 show a partial sectional view taken from FIG. 2 on an enlarged scale to illustrate operation of the example magazine catch of FIG. 2.

DETAILED DESCRIPTION

Figure 4:
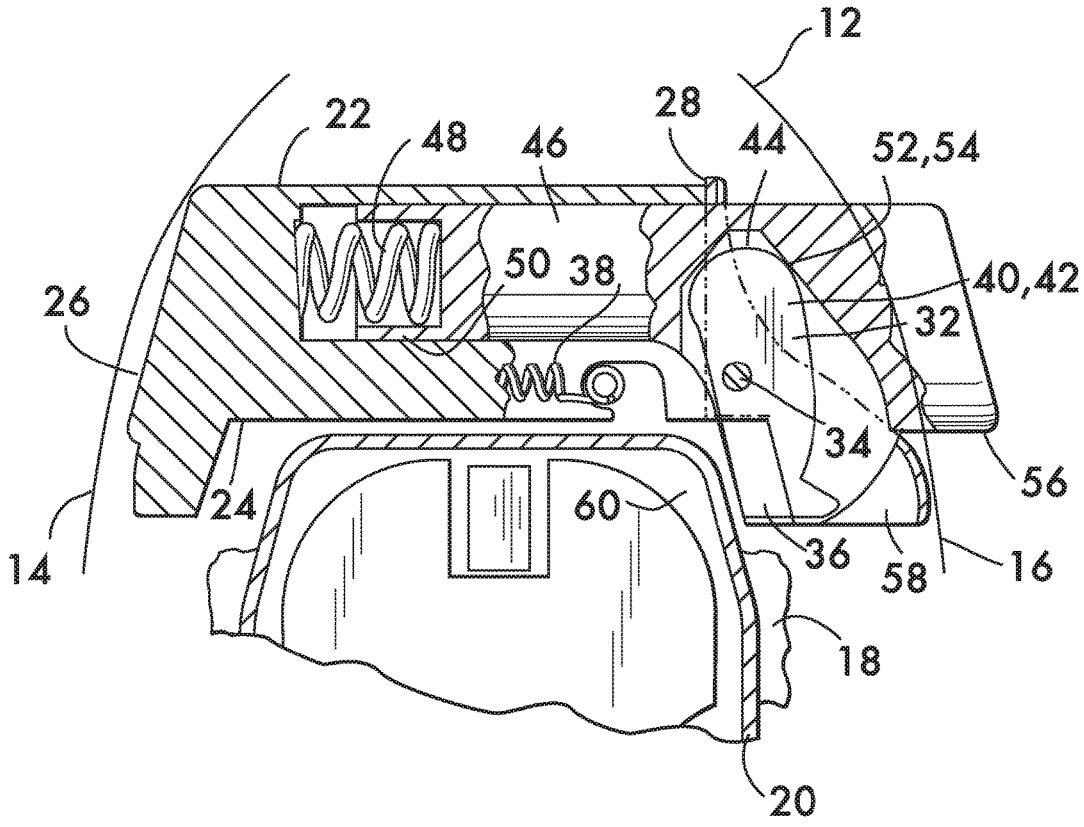

FIGS. 1 and 2 show an example firearm, in this example a semiautomatic pistol 10 according to the invention. Pistol 10 comprises a frame 12 having first and second sides 14 and 16 oppositely disposed from one another. Frame 12 defines a magazine well 18 between sides 14 and 16. The magazine well 18 receives an ammunition magazine 20.

A magazine catch 22 is mounted on frame 12 adjacent to the magazine well 18. As shown in FIG. 3, magazine catch 22 comprises a body 24 having a first end 26 positioned proximate to the first side 14 of frame 12. A second end 28 of the body 24 is positioned proximate to the second side 16. Body 24 is slidably movable relatively to frame 12 in a direction 30 oriented transversely to the first and second sides 14 and 16 of frame 12.

A dog 32 is positioned proximate to the second end 28 of body 24. Dog 32 is rotatably mounted on body 24 for rotation about an axis 34 oriented transversely to body 24. Dog 32 has a jaw 36 positioned on one side of axis 34. Jaw 36 is movable toward and away from the magazine well 18 upon motion of the body 24 or rotational motion of the dog 32 about axis 34. A body spring 38 acts directly between the frame 12 and the body 24 for biasing the jaw 36 into a position within the magazine well 18. The phrase "acts directly" means there are no intervening parts between the spring and the frame or the spring and the body, i.e., the spring engages the frame and the spring engages the body. A cam follower 40 is positioned on an opposite side of the axis 34 from jaw 36. In this example embodiment the cam follower 40 comprises a lobe 42 integrally formed with jaw 36. The lobe 42 has a curved perimeter 44 in this example.

A plunger 46 engages the second end 28 of body 24. Plunger 46 is movable relatively to body 24 toward and away from its first end 26. A plunger spring 48 acts between the body 24 and the plunger 46 to bias the plunger away from the body first end 26. In this example the plunger spring 48 is received within a cavity 50 defined within the body 24. Cavity 50 extends between the first and second ends 26 and 28 of the body 24. A cam surface 52 is positioned on the plunger 46. In this example the cam surface 52 is defined by an interior surface 54 of a shroud 56. Shroud 56 is part of the plunger 46 and surrounds at least a portion of the dog 32, specifically lobe 42. The shroud is advantageous because it shields the catch from dirt and debris which might otherwise enter and foul the mechanism. The cam surface 52 of shroud 56 engages the cam follower 40 (perimeter 44 of lobe 42) of dog 32. Motion of the plunger 46 toward and away from the first end 26 of body 24 effects rotation of dog 32 about axis 34 through the engagement between the cam surface 52 and the cam follower 40 as shown by a comparison of FIGS. 3 and 5. It is further advantageous for body 24 to have a cover 58 mounted on the second end 28 of the body 24. Cover 58 covers at least a portion of jaw 36 on dog 32 and affords additional protection to the catch 22.

Figure 5:
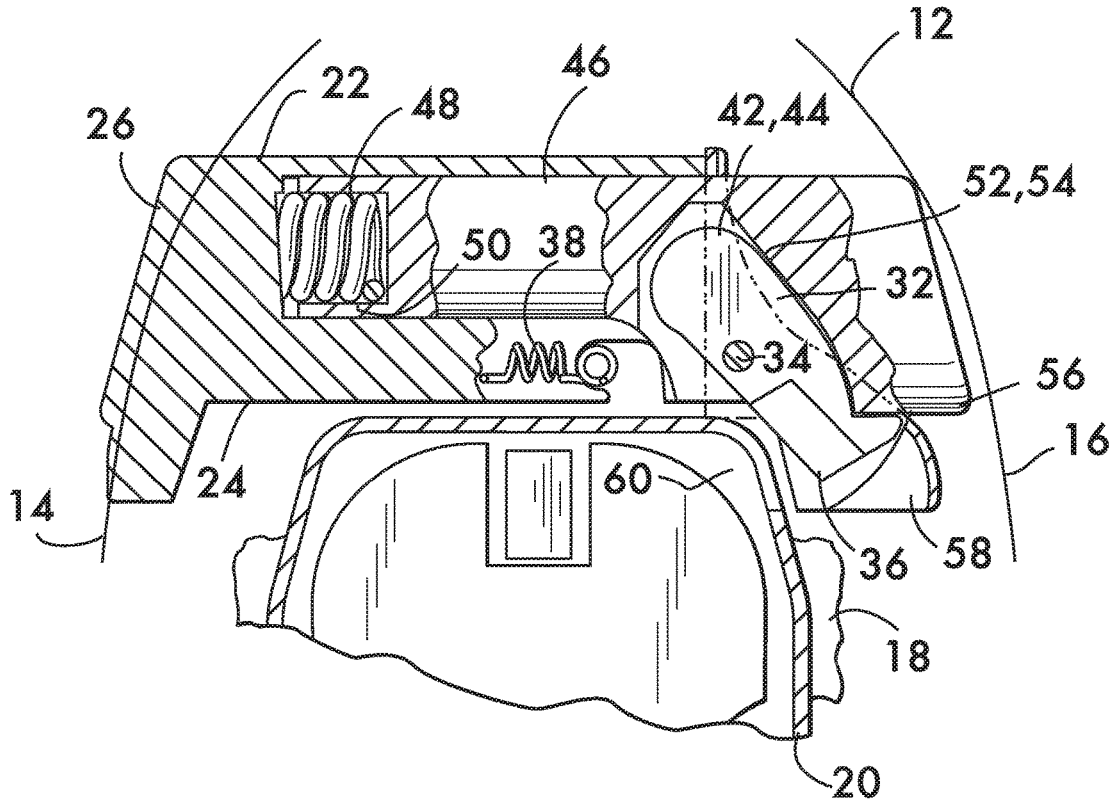

Operation of the magazine catch 22 is illustrated in FIGS. 3-5. As shown in FIG. 3, the body spring 38 biases the body 24 toward the first side 14 of the frame 12 and maintains the jaw 36 at a position within the magazine well 18. When a magazine 20 is present the jaw 36 will engage a slot 60 in the magazine (see also FIG. 3A) and thereby retain it within the magazine well 18.

FIG. 4 shows release of the magazine 20 when the first end 26 of the body 24 is depressed toward the frame 12. Body 24 moves in the direction transversely toward the second side 16 of frame 12 against its biasing spring 38, carrying dog 32 with it. This causes the jaw 36 to move out of the magazine well 18 and disengage from the slot 60 in the magazine 20, releasing the magazine which can then be removed.

FIG. 5 shows release of the magazine 20 when the plunger 46 is depressed toward the first end 26 of body 24. Plunger 46 moves into the cavity 50 within the body 24, compressing the plunger spring 48. The cam surface 52 within shroud 56 acts on cam follower 40 on lobe 42 of dog 32, rotating the dog about axis 34. This causes the jaw 36 opposite the lobe to move out of engagement with the slot 60 in the magazine 20, thereby releasing the magazine from the magazine well 18. Upon release of the plunger 46 the plunger spring 48 moves the plunger away from the first end 26 of body 24 and the cam surface 52 within shroud 56 acts on the cam follower 40 to rotate the jaw back into the magazine well as depicted in FIG. 3.

It is expected that magazine catches according to the invention will afford ambidextrous magazine release and also improve retention of the magazine during recoil when the pistol is fired because motion of the catch is perpendicular to the firing axis of the pistol.

What is claimed is:

1. A magazine catch for a firearm having a magazine well, said catch comprising:

a body mountable on said firearm adjacent to said magazine well, a first end of said body being positionable proximate to a first side of said firearm, a second end of said body being positionable proximate to a second side of said firearm disposed oppositely from said first side, said body being movable in a direction oriented transversely to said first and second sides;

a dog positioned proximate to a second end of said body, said dog being attached to said body for rotation about a rotation axis, said dog having a jaw positioned on one side of said rotation axis and a cam follower positioned on an opposite side of said rotation axis;

a body spring acting directly between said firearm and said body and biasing said jaw toward said magazine well;

a plunger engaging said second end of said body, said plunger being movable toward and away from said first end of said body;

a plunger spring acting between said body and said plunger for biasing said plunger away from said first end of said body;

a cam surface positioned on said plunger, said cam surface engaging said cam follower and rotating said dog upon motion of said plunger toward and away from said first end of said body; wherein said jaw is movable toward and away from said magazine well upon motion of said body transversely to said firing axis and motion of said plunger relatively to said body.

2. The magazine catch according to claim 1, wherein:

said body defines a cavity extending between said first and second ends thereof;

said plunger being received within said cavity, said plunger spring being located within said cavity.

3. The magazine catch according to claim 2, wherein said plunger further comprises a shroud surrounding at least a portion of said dog.

4. The magazine catch according to claim 3, wherein said shroud has an interior surface defining said cam surface.

5. The magazine catch according to claim 1, further comprising a cover positioned on said second end of said body, said cover overlying at least a portion of said jaw.

6. The magazine catch according to claim 1, wherein said rotation axis is oriented transversely to said body.

7. The firearm according to claim 1, wherein said cam follower comprises a lobe having a curved perimeter.

8. A firearm, comprising:

a frame having first and second sides oppositely disposed, said frame defining a magazine well therebetween;

a body mounted on said frame adjacent to said magazine well, a first end of said body being positioned proximate to said first side of said frame, a second end of said body being positioned proximate to said second side of said frame, said body being movable transversely to said first and second sides of said frame;

a dog positioned proximate to said second end of said body, said dog being attached to said body for rotation about a rotation axis, said dog having a jaw positioned on one side of said rotation axis and a cam follower positioned on an opposite side of said rotation axis;

a body spring acting directly between said firearm and said body and biasing said jaw toward said magazine well;

a plunger engaging said second end of said body, said plunger being movable toward and away from said first end of said body;

a plunger spring acting between said body and said plunger for biasing said plunger away from said first end of said body;

a cam surface positioned on said plunger, said cam surface engaging said cam follower and rotating said dog upon motion of said plunger toward and away from said first end of said body; wherein said jaw is movable toward and away from said magazine well upon motion of said body transversely to said sides of said frame and motion of said plunger relatively to said body.

9. The firearm according to claim 8, wherein:

said body defines a cavity extending between said first and second ends thereof;

said plunger being received within said cavity, said plunger spring being located within said cavity.

10. The firearm according to claim 9, wherein said plunger further comprises a shroud surrounding at least a portion of said dog.

11. The firearm according to claim 10 wherein said shroud has an interior surface defining said cam surface.

12. The firearm according to claim 8, further comprising a cover positioned on said second end of said body, said cover overlying at least a portion of said jaw.

13. The firearm according to claim 8, wherein said rotation axis is oriented transversely to said body.

14. The firearm according to claim 8, wherein said cam follower comprises a lobe having a curved perimeter.

* * * * *